US008567620B2

(12) United States Patent
Ettlin et al.

(10) Patent No.: US 8,567,620 B2
(45) Date of Patent: Oct. 29, 2013

(54) CONTAINER HAVING A SHOCK-ABSORBING ELEMENT

(75) Inventors: Josef Ettlin, Eichberg (CH); Sasan Habibi-Naini, Rikon (CH)

(73) Assignee: Sulzer Mixpac AG, Haag (CH)

( * ) Notice: Subject to any disclaimer, the term of this patent is extended or adjusted under 35 U.S.C. 154(b) by 254 days.

(21) Appl. No.: 12/925,105

(22) Filed: Oct. 13, 2010

(65) Prior Publication Data

US 2011/0094989 A1 Apr. 28, 2011

(30) Foreign Application Priority Data

Oct. 26, 2009 (EP) ..... 09174038

(51) Int. Cl.
*B65D 1/02* (2006.01)
*B65D 25/42* (2006.01)

(52) U.S. Cl.
USPC ..... 215/40; 215/6; 222/572

(58) Field of Classification Search
USPC ..... 215/6, 40–42, 391, 392, 288, DIG. 7; 220/500, 506; 222/94, 572; 401/262
See application file for complete search history.

(56) References Cited

U.S. PATENT DOCUMENTS 1,635,070 A * 7/1927 Clark ..... 215/2
2,093,189 A * 9/1937 Harold ..... 215/41
2,341,102 A * 2/1944 Kanzaki ..... 215/41
3,200,998 A * 8/1965 Mahar ..... 222/184
3,269,389 A * 8/1966 Meurer et al. ..... 128/200.14
3,826,394 A * 7/1974 Stull ..... 215/224
4,086,011 A * 4/1978 Kuparinen ..... 401/258
4,362,250 A * 12/1982 Cottingham ..... 215/247
4,416,381 A * 11/1983 Swartwout ..... 215/228
4,585,149 A * 4/1986 Zulauf ..... 222/94
RE33,969 E * 6/1992 Richter ..... 222/1
5,154,526 A * 10/1992 Bothe ..... 401/258
5,340,228 A * 8/1994 Wilcox et al. ..... 401/262
5,667,107 A * 9/1997 Lindsey ..... 222/173
5,921,440 A * 7/1999 Maines ..... 222/145.2
6,076,688 A * 6/2000 Forget ..... 215/44
6,105,812 A * 8/2000 Riordan ..... 220/504
6,364,180 B1 * 4/2002 Cardenas ..... 222/541.2
6,877,638 B2 * 4/2005 Chan et al. ..... 222/145.3
6,953,297 B2 * 10/2005 Dobbs et al. ..... 401/188 R
7,306,126 B2 * 12/2007 Brugner ..... 222/485
7,938,296 B2 * 5/2011 Keller ..... 222/145.5
2005/0103801 A1 5/2005 Felten
2006/0253089 A1 * 11/2006 Lin ..... 604/301
2007/0007302 A1 1/2007 Jaichandra

FOREIGN PATENT DOCUMENTS

DE 43 33 812 A1 4/1995
EP 0 587 070 A2 3/1994
EP 1 500 606 A2 1/2005

* cited by examiner

*Primary Examiner* — Sue A Weaver
(74) *Attorney, Agent, or Firm* — Francis C. Hand; Carella, Byrne, et al

(57) ABSTRACT

A container includes a storage chamber for the reception of a filler material and a neck which contains a discharge passage for dispensing the filler material. The neck is surrounded by a shock absorbing element that has a first end connected to the neck, a jacket circumferentially spaced about the neck to form an intermediate space and a second end also spaced from the neck. The shock absorbing element ensures that the neck remains intact on an impact.

19 Claims, 11 Drawing Sheets

CONTAINER HAVING A SHOCK-ABSORBING ELEMENT

This invention relates to a container having a shock-absorbing element. More particularly, this invention relates to a cartridge having a shock-absorbing element for protecting a dispensing neck of the cartridge.

As is known, containers can be designed as a cartridge which is in particular used for the processing of a plurality of components. Cartridges of this type contain a filler material which is dispensed for a specific application. The cartridge is, in particular, suitable for the simultaneous dispensing of at least two components which can be mixed before use.

Conventional cartridges are used for the metering of typically small amounts of a filler material. A cartridge is, in its simplest embodiment, a tube with a neck. The tube serves as a storage chamber for the filler material. The tube opens into the neck at the dispensing end. A piston which is movable to and fro within the tube is located at the oppositely disposed end which should be called a conveying end. The neck contains a discharge passage which opens into a discharge opening through which the filler material can be discharged continuously as a jet or discontinuously in drop form. The user displaces the piston in the direction of the neck to dispense the filler material. The filler material leaves the cartridge through the discharge passage of the neck and is applied to the location desired by the user. A plurality of alternatives are available for the filling of the cartridge with filler material.

Filling of the cartridge may be accomplished in several manners depending on the type of filler material. For example, for a thin or very viscous filler material, the piston is brought into a position with a minimal spacing from the discharge opening. The neck of the cartridge is then immersed into a reservoir with filler material. In the meantime, the piston is moved away from the discharge opening by the filler material so that filler material is introduced into the storage chamber from the reservoir. As the movement of the piston in the direction of the conveying end of the cartridge progresses, the storage chamber is successively filled with filler material until the piston has reached its end position at the conveying end.

In accordance with a second alternative, the piston is removed from the storage chamber and the neck of the cartridge is either closed immediately, if the filler material is thin, or can remain provisionally open for the discharge of air present in the storage chamber. The filler material is introduced into the storage chamber from the conveying end. The filling can take place by means of a filling device. The filling device is, in its simplest form, a hose connected to a reservoir which is docked to the conveying end of the cartridge. The storage chamber of the cartridge is filled with filler material by means of a pumping apparatus connected to the hose. After the end of the filling process, the piston is inserted into the storage chamber again so that the filler material in the storage chamber is enclosed between the piston and the still closed discharge opening. The cartridge is now prepared for the application and can be stored and transported in the filled state.

Alternatively, it is known to carry out the venting via the piston and/or the inner wall of the cartridge during the filling. In this case, the discharge opening can already be closed, for example by a closure cap which is screwed onto the neck containing the discharge opening, as is shown, for example, in EP 0 578 897 Alternatively to this, a closure cap can be provided which is made in one piece with the cartridge neck such as is shown in EP 1 491 460 A2. This closure cap is connected to the discharge opening via a desired breakage point such that the discharge opening remains closed for so long until the desired breakage point is severed by tearing off the closure cap.

The combination of a closure cap in accordance with EP 1 491 460 A2 and of a screw closure is shown in U.S. Pat. No. 4,402,417.

If shocks occur on transport, the cartridge, in particular the cartridge neck, can be damaged. A sleeve for a bottle is therefore disclosed in U.S. Pat. No. 4,402,417 which is screwed onto the thread present at the neck and protects the outlet opening from shocks like a closure cap. For this purpose, the sleeve of U.S. Pat. No. 4,402,417 has finger elements which hold the actual closure cap closed. If, however, the neck impacts an obstacle at an angle to the vertical, the closure cap could open inadvertently along the connection to the discharge opening made as a desired breakage point since the forces are transmitted by the sleeve via the thread directly onto the finger elements and the discharge opening.

The sleeve therefore only provides inadequate protection against a running out of the filler material.

It is therefore an object of the invention to provide a solution by means of which the neck of a cartridge can be secured against transport damage and remain intact on an impact at any angle.

It is another object of the invention to reliably prevent a discharge of filler material as a consequence of an impact of a cartridge onto an obstacle.

Briefly, the invention provides a container comprising at least one storage chamber for the reception of a filler material; a neck extending from the chamber and having a discharge passage for dispensing of the filler material from the storage chamber; and a shock absorbing element having a first end connected to neck, a jacket extending from the first end in spaced circumferential relation to the neck to define an intermediate space therebetween and a second end on the jacket opposite the first end and in spaced circumferential relation to the neck. The neck is surrounded by the shock absorbing element such that an intermediate space is formed in which the neck is completely contained.

In one embodiment, the container has a pair of storage chambers and the neck has a first discharge passage communicating with one of the storage chambers, a second discharge passage communicating with the other of the storage chambers and a collar integrally connected to the pair of storage chambers and to the first end of the shock absorbing element.

In this embodiment, the neck has a first tube piece defining the first discharge passage and having a first discharge opening on a longitudinal axis of the neck and a second tube piece defining the second discharge passage and having a second discharge opening concentric to the first discharge opening. In addition, the second tube piece is connected to the collar and the first end of the shock absorbing element is connected to the second tube piece at the collar.

In another embodiment, the container has a single storage chamber and the neck has a single discharge passage with an outer diameter which is smaller than the inner diameter of the shock absorbing element, such that the neck is surrounded by the shock absorbing element. The shock absorbing element has a first end which is connected to the neck at the collar.

The container is in particular a cartridge including at least one storage chamber for the reception of a filler material, with the storage chamber having a volume which is changeable and having a cartridge neck which contains at least one discharge passage for the filler material so that the filler material can be dispensed from the storage chamber through the cartridge neck. The cartridge neck is surrounded by the shock absorbing element which is made in one piece with the cartridge neck.

The shock absorbing element is in particular made such that the second end projects over the neck. It is hereby ensured that the neck remains intact on an impact since the shock forces can be reduced by the deformation of at least the second end.

The intermediate space formed by the spacing between the jacket and the neck is able to receive a housing element. A mixer can be or is connected to the neck, in particular when the container is made as a multicomponent cartridge. The or each of the discharge passages open into the mixer. The mixer is accommodated in an associated housing element which is pushed over the neck or is plugged into the neck. This housing element will be called a mixer housing. The mixer housing can be connected to the neck via a thread. The discharge passage is provided with an external thread onto which the housing element can be screwed.

The connection can, however, also take place via a bayonet connection, a latch connection or via a snap connection, which is not shown graphically. The mixer can in particular be made as a static mixer. A static mixer includes a plurality of flow-deflecting installations which are arranged in the mixer housing. The use of a mixer is in particular advantageous when the cartridge is used for a filler material which is made up of a plurality of flowable components.

In accordance with an advantageous embodiment, the jacket is arranged concentrically around the neck. The neck is typically a rotationally symmetrical element. The jacket can also be designed as a rotationally symmetrical element. The common axis of the neck and the jacket is the longitudinal axis of the neck. The mixer housing has a maximal diameter dimension which is smaller than the inner diameter of the jacket so that it is rotatable within the jacket. Alternatively to this, the mixer housing can, for example, enter into a plug-in connection a latch connection, a snap connection or a bayonet connection with the jacket. Encoding means can in particular be provided such as are shown in EP 7 390 913 to put on the mixer housing in a precisely defined position relative to the cartridge.

The jacket of the shock absorbing element advantageously has a substantially cylindrical inner wall. This cylindrical inner wall can be manufactured easily with the corresponding injection molding tool and allows the removal of the tool by means of which the neck is manufactured. For this purpose, the jacket contains an opening so that the tool can be removed through the opening after completion of the neck.

The shock absorbing element is made in one piece with the neck in accordance with a preferred embodiment, that is the shock absorbing element is manufactured as a single element together with the neck and the total cartridge. This functional integration is not known from the solutions in accordance with the prior art since previously at least two elements were required for this purpose, even with containers which only contain one component. The first component includes the cartridge or the container with the neck. The second element includes a protective cap or closure cap located thereon which can optionally contain a discharge opening having a small cross-section which is intended to allow the user to dispense small dosages or portions of the desired component.

A closure cap is provided for mounting on the neck for closing a discharge opening of the discharge passage. For the better protection of the closure cap, the shock absorbing element projects over the closure cap, i.e. projects longitudinally beyond the closure cap, in the closed state. Not only the neck of the container, but also the closure cap is therefore protected against an impact. Since no forces are transmitted to the closure cap by the shock absorbing element, it is also very unlikely that the closure cap is opened inadvertently on an impact, that is, that filler material can be discharged from the container.

The closure cap is advantageously connected to the shock absorbing element by means of a hinge element. The use of a hinge element has the advantage that the discharge opening can be closed again. This means that the user has the option of dispensing a portion of the container content, of closing the closure cap and of thus storing a further portion of the container content for later use.

The closure cap can have a margin which is spaced circumferentially from the jacket of the shock absorbing element with the closure cap in a closure position. The margin can be made as a projection which can in particular extend over at least a large part of the periphery of the closure cap.

An engagement element can be arranged on the shock absorbing element and can receive a flap of the closure cap to hold the closure cap in the closed state. The hinge element is preferably designed such that it remains in the open position in the unloaded state. After the closure cap has been moved into the closed state, the flap engages into the engagement element to hold the closure cap in the closed state.

The closure cap has a reception element into which the end of the discharge passage engages when the discharge opening is closed. The closure cap can for this purpose have at least one ring-shaped groove into which the end of the neck is received which forms the end of the discharge passage when the closure cap is closed. The end of the neck is received in the corresponding groove. If a plurality of discharge passages are provided, the neck can accordingly have a plurality of ends. In addition, a small compressive force can be exerted onto the end of the neck in the closed state by the closure cap so that a sealing against the discharge of filler material is present. A labyrinth which forms a filter path can also be formed by the walls of the groove. This filter path has such a small opening width that the filler material cannot move into the gap between the groove and the end of the neck.

Alternatively to this, the end of the discharge passage can have a curvature directed in the direction of the longitudinal axis of the discharge passage. In addition, the wall thickness at the end of the discharge passage can be smaller than the wall thickness upstream of the end. When the closure cap is closed, the curvature of the discharge passage can be increased. The end of the discharge passage is hereby curved in the direction of the longitudinal axis when it is received in the groove of the closure cap. An increased force is exerted onto the inner wall of the groove by this curving so that a sealing effect is given.

Alternatively to this, the groove can have a conical cross-section so that a sealing connection is established in the closed state between the end of the neck forming the discharge passage and the closure cap in the closed state. The end of the neck is clamped between the two conical side walls of the groove so that the filler material cannot pass clamping points at which the sidewall of the groove of the end of the discharge passage contacts the closure cap.

The storage chamber can have a volume which is changeable. When the filler material is dispensed, the volume of the storage chamber is reduced by a compressive force applied to the wall of the storage chamber since the wall is made from a resilient material. The storage chamber can, for example, be made as a tube or as a tubular bag. Alternatively to this, the volume of the storage chamber can be changed in that a piston is moved to and fro along the inner wall of the storage chamber.

In accordance with an advantageous embodiment, the container in accordance with any one of the preceding embodiments contains at least one first part chamber and one second part chamber. The first part chamber can receive a first component and the second part chamber can receive a second component. The first part chamber opens into a first discharge passage and the second part chamber opens into a second discharge passage, with the first discharge passage having a first discharge opening and the second discharge passage having a second discharge opening. In the following, such containers will also be called multicomponent cartridges. It results as an additional advantage for a multicomponent cartridge that each of the components can be stored separately in the cartridge, but that, as required, only the closure cap has to be opened, a mixer is placed onto each of the discharge openings and the two components cannot only be discharged simultaneously, but are also mixed simultaneously.

The first discharge passage and the second discharge passage can be arranged in the neck. The first discharge passage opens into a first discharge opening which is arranged in a first end of the neck. The second discharge passage opens into a second discharge opening which is arranged in a second end of the neck. The first end of the neck can extend within the second end of the neck so that the second end is arranged in ring shape around the first end. The first end can in particular be arranged concentrically within the second end.

Alternatively to this, the second end can be arranged next to the first end. The first end and the second end are separated from one another by a partition wall.

In each of the cases, the second end is received in the neck such that the neck has a rotationally symmetrical outer side, that is in particular a cylindrical or conical outer side. This has the advantage that the neck can have a fastening means for the mixer at its outer side. The already described external thread can in particular be provided for this purpose.

In accordance with a particularly preferred embodiment, the first discharge opening is arranged coaxially to the second discharge opening and the first discharge passage is arranged within the second discharge passage, with the first discharge passage being separated from the second discharge passage by an intermediate wall. The intermediate wall is in this case arranged concentrically to the jacket of the neck. The first component thus flows in the interior of the intermediate wall which bounds the first discharge passage.

The second component flows outside the intermediate wall through the second discharge passage which is arranged in ring shape around the first discharge passage.

Alternatively to this, the first discharge passage can be arranged next to the second discharge passage. The first discharge opening is arranged next to the second discharge opening and the first discharge passage is arranged next to the second discharge passage, with the first discharge passage being separated from the second discharge opening by an intermediate wall.

In accordance with a variant, the first discharge passage can be received in a first neck and the second discharge passage can be received in a second neck. The respective neck of the cartridge can be made as a tubular stub which contains a respective discharge passage. The first discharge passage is connected to the first part chamber and the second discharge passage is connected to the second part chamber.

In this case, the mixer is placed onto the first and second necks to connect the discharge passages present in the respective neck so that the first and second components are only combined and mixed in the mixer.

In accordance with an alternative embodiment, the discharge passages run in a single neck. The neck also contains a partition wall in this case; however, this partition wall divides the cross-sectional area into two parts. Depending on the desired portion of the components in the mixture, the parts can have equal cross-sectional areas or cross-sectional areas differing from one another. A plurality of partition walls can naturally also be provided. The partition walls can divide the cross-section into individual segments or sectors so that the discharge passages extend substantially next to one another.

Each of the discharge passages is fed from a storage chamber. A multicomponent cartridge thus includes a plurality of part chambers. In accordance with a preferred embodiment, the storage chamber contains a first part chamber which contains a first flowable component and a second part chamber which contains a second flowable component. In accordance with this embodiment, the cartridge can be used for the metering of two or more flowable components.

The part chambers of the multicomponent cartridge can either be arranged next to one another or the first storage chamber can be arranged within the second storage chamber.

An expulsion element can be arranged in each of the storage chambers to dispense the filler material from the storage chamber.

In the embodiment of the cartridge as a multicomponent cartridge for the simultaneous conveying of a plurality of flowable components, the expulsion element includes a first piston and at least one second piston. The first piston can be movably received in the first part chamber and the second piston can be movably received in the second part chamber so that, on movement of at least one of the first or second pistons, the first and second flowable components can be dispensed simultaneously.

The first and second pistons are movable by means of a plunger in accordance with a preferred embodiment. The plunger can be made in one piece with the first piston or the second piston. The plunger can be part of a discharge device such as an expulsion gun.

The storage chamber or the first and second part chambers can be at least partly transparent so that the filling level can be monitored. The housing is in particular made of a transparent material, for example a transparent plastic, so that when the cartridge is being filled, it is visually recognizable for the user how much filler material is already present in the storage chamber. In the same way, it can be recognized for each of the first or second chambers how high the portion is of the first or second flowable components in the filling volume. A scale can be attached to the outer side of the housing in the region of the storage chamber or of the first or second part chamber which provides the user with an indication of which filling volume the already filled in filler material contains.

It is accordingly also possible only to fill the cartridge partly if only a part of the filling volume is required. The application of an adhesive or of a sealing material can, for example, be named as an example for such an application. Depending on the size of the adhesive point or of the point to be sealed, the cartridge can be filled precisely with the amount of filler material required for this purpose or precisely with the plurality of flowable components which are required at the adhesive point or of the point to be sealed.

The invention will be explained with reference to the drawings in the following. There are shown:

Figure 1:
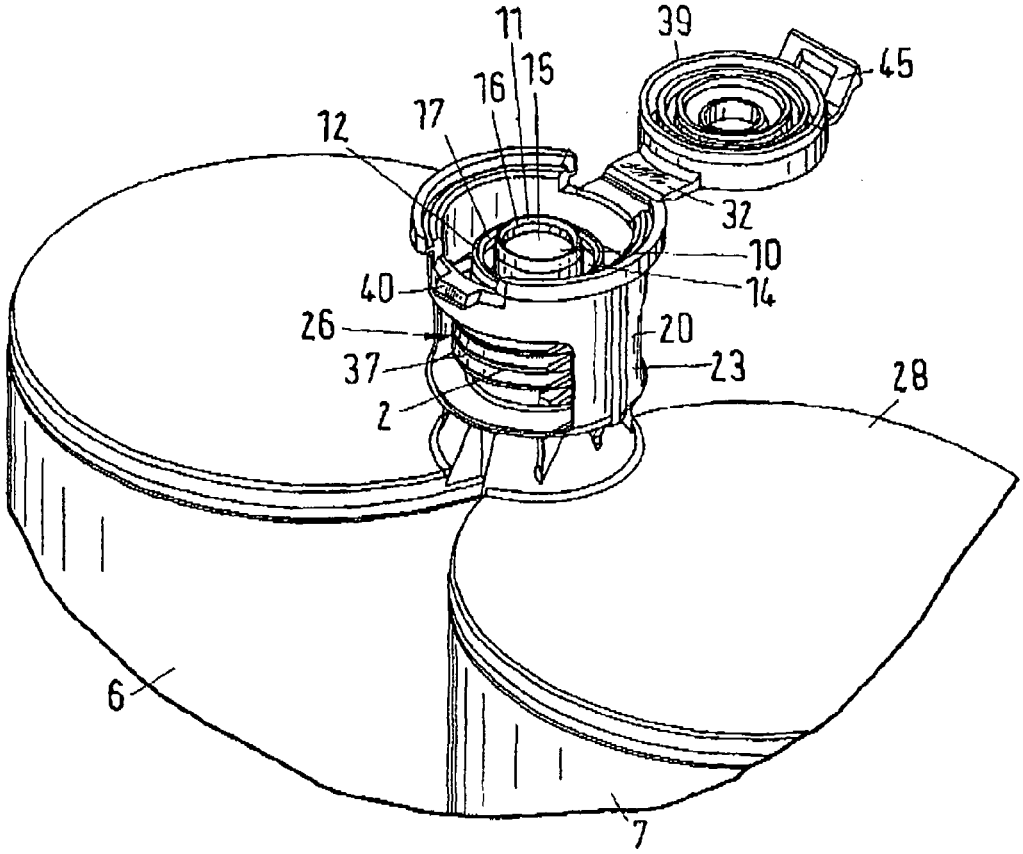
FIG. 1 illustrates a view of the neck of a cartridge in accordance with a first embodiment of the invention.
Figure 4:
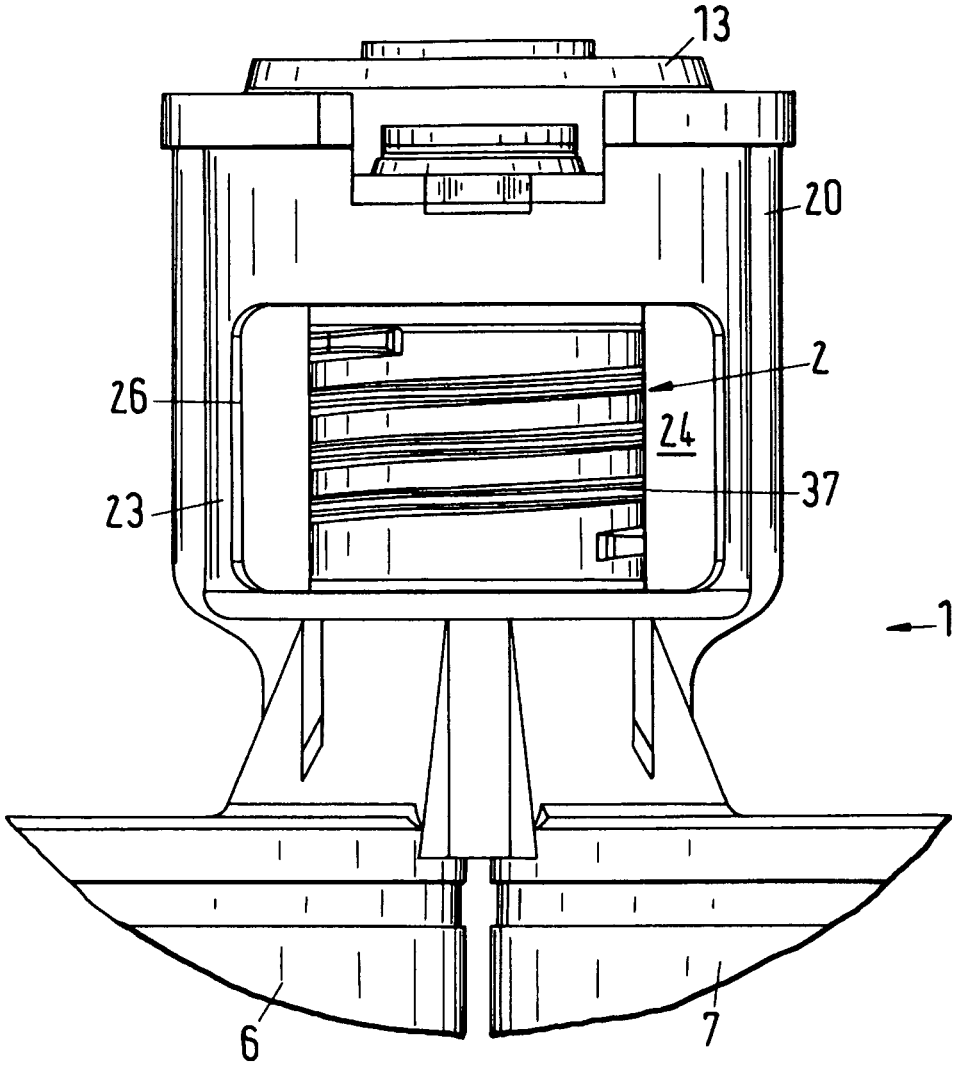
FIG. 4 illustrates a front view of the neck of the cartridge of FIG. 1.
Figure 6:
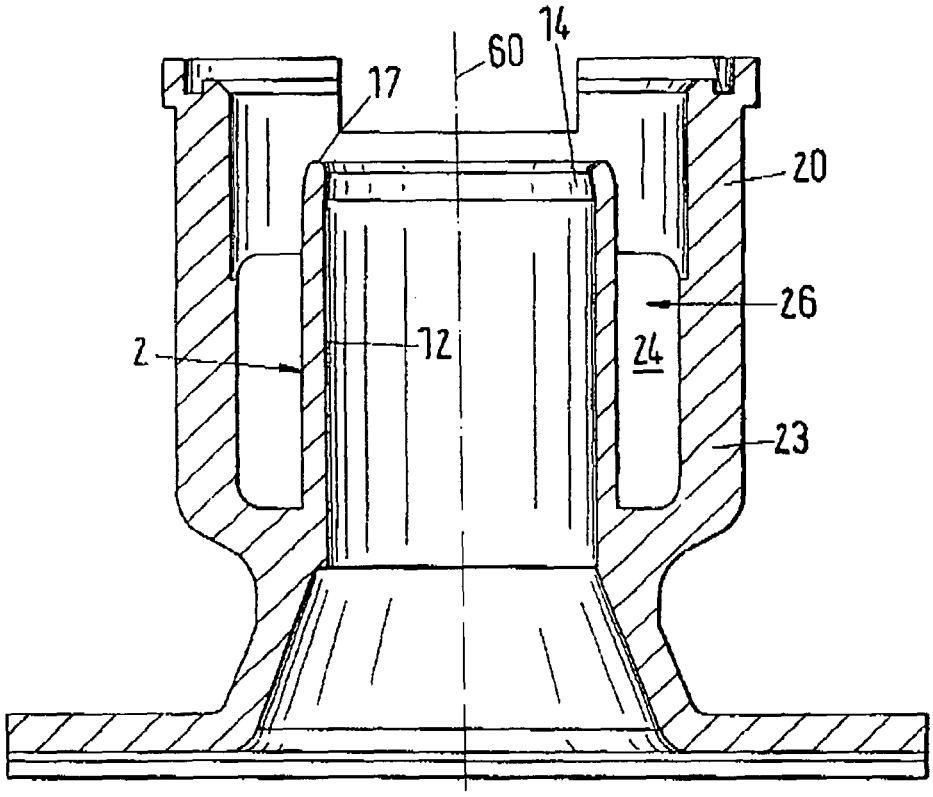
FIG. 6 illustrates a section through the neck of a cartridge with a single storage chamber in accordance with the invention.
Figure 8:
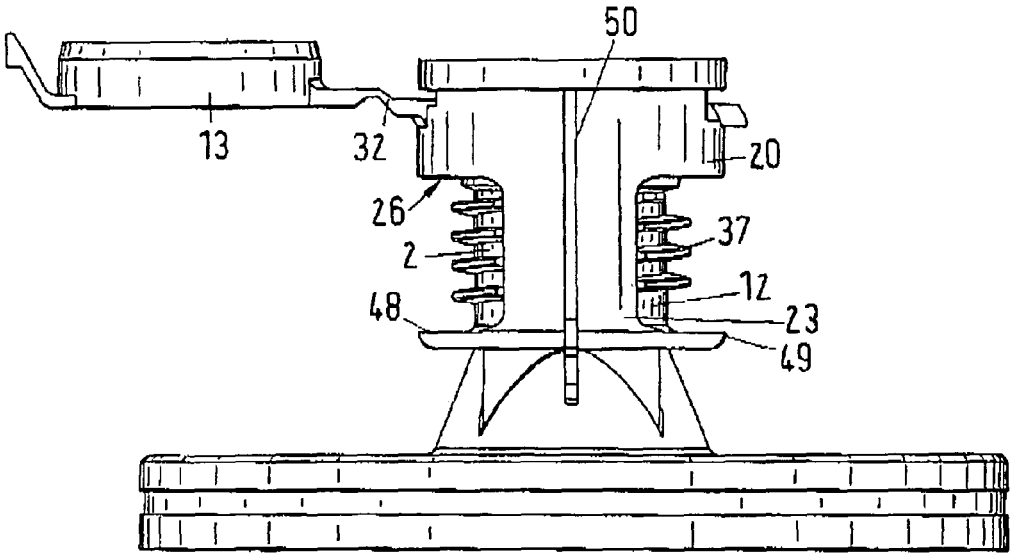
Figure 9:
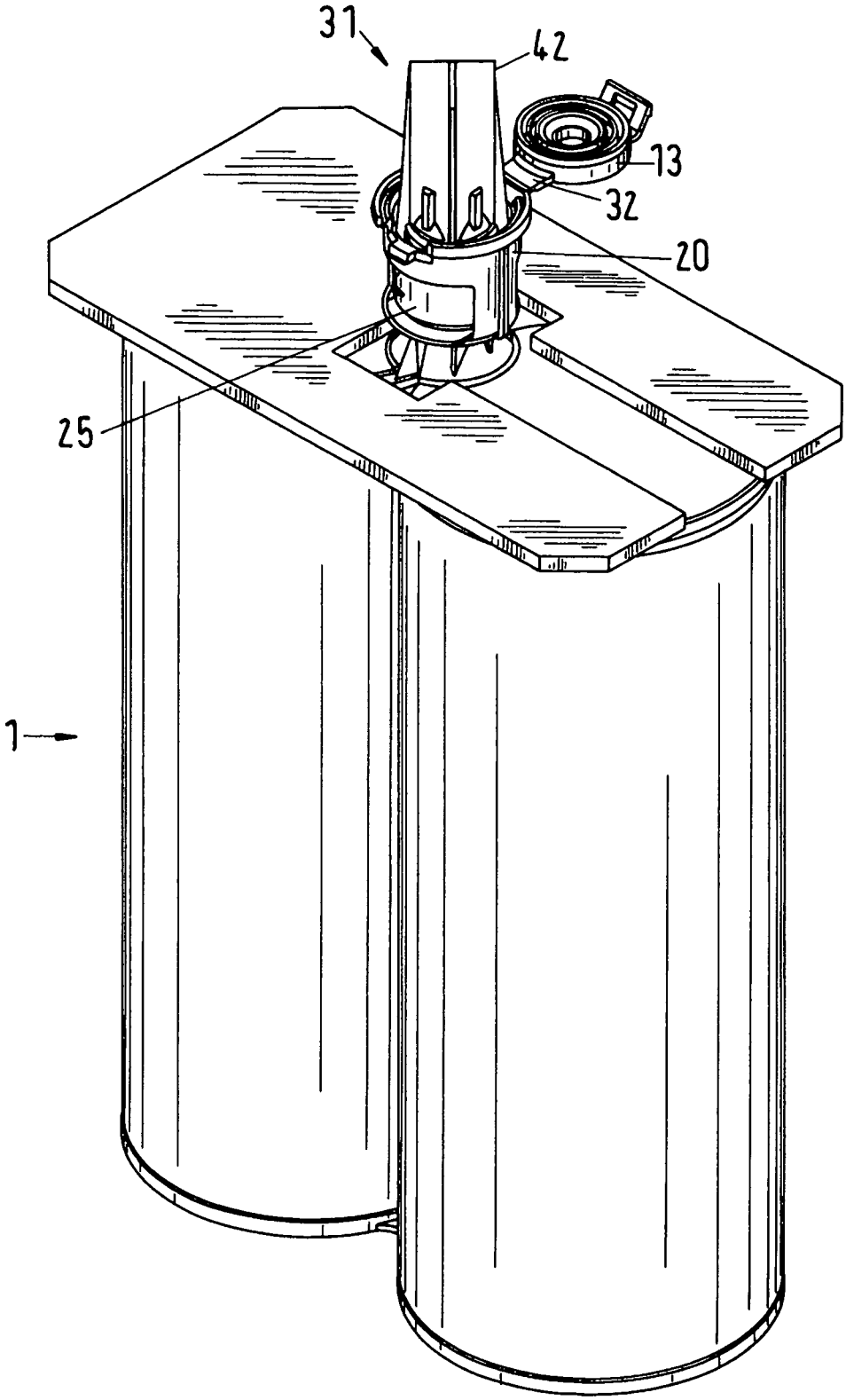
Figure 10:
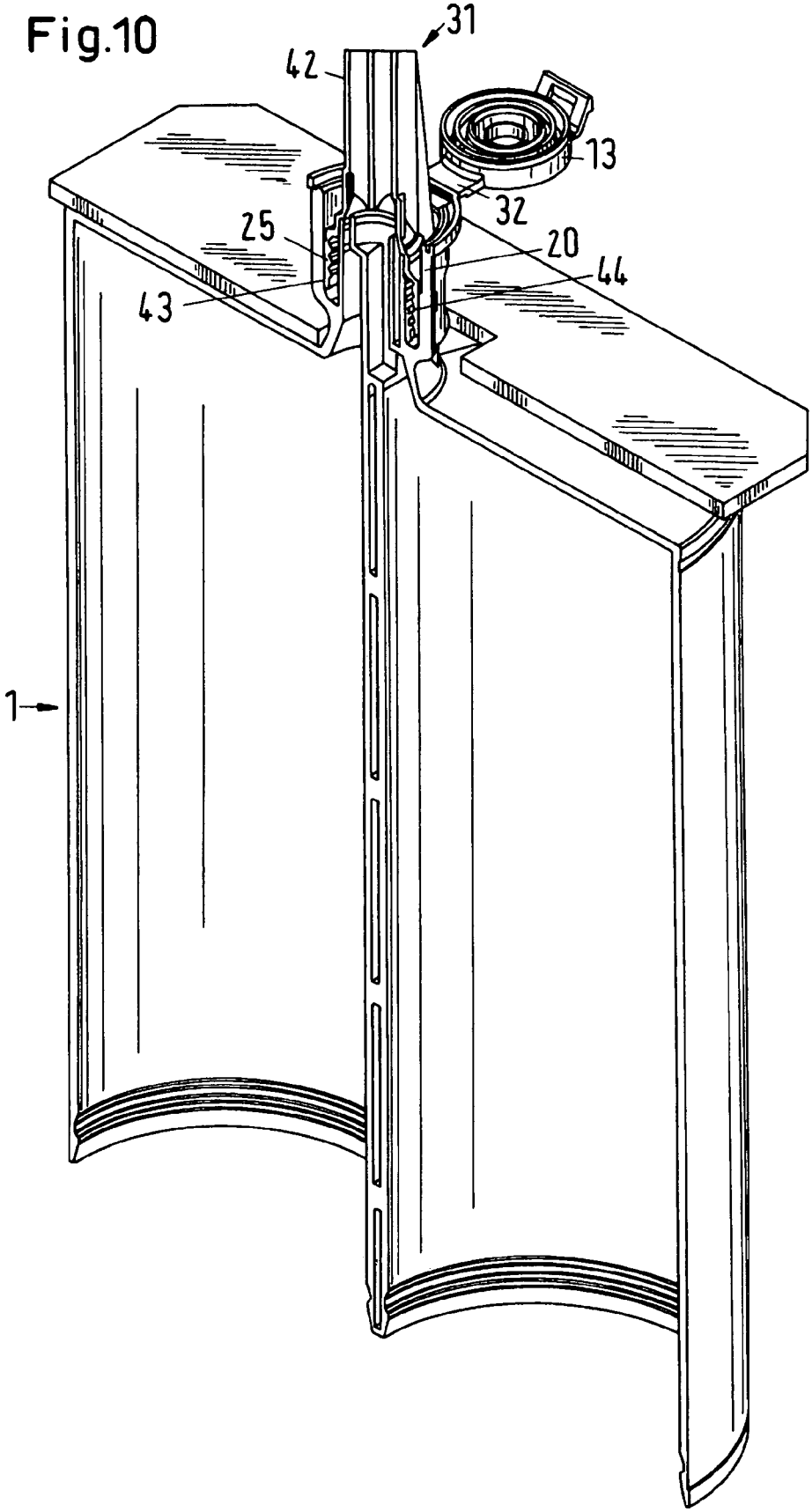
Figure 11:
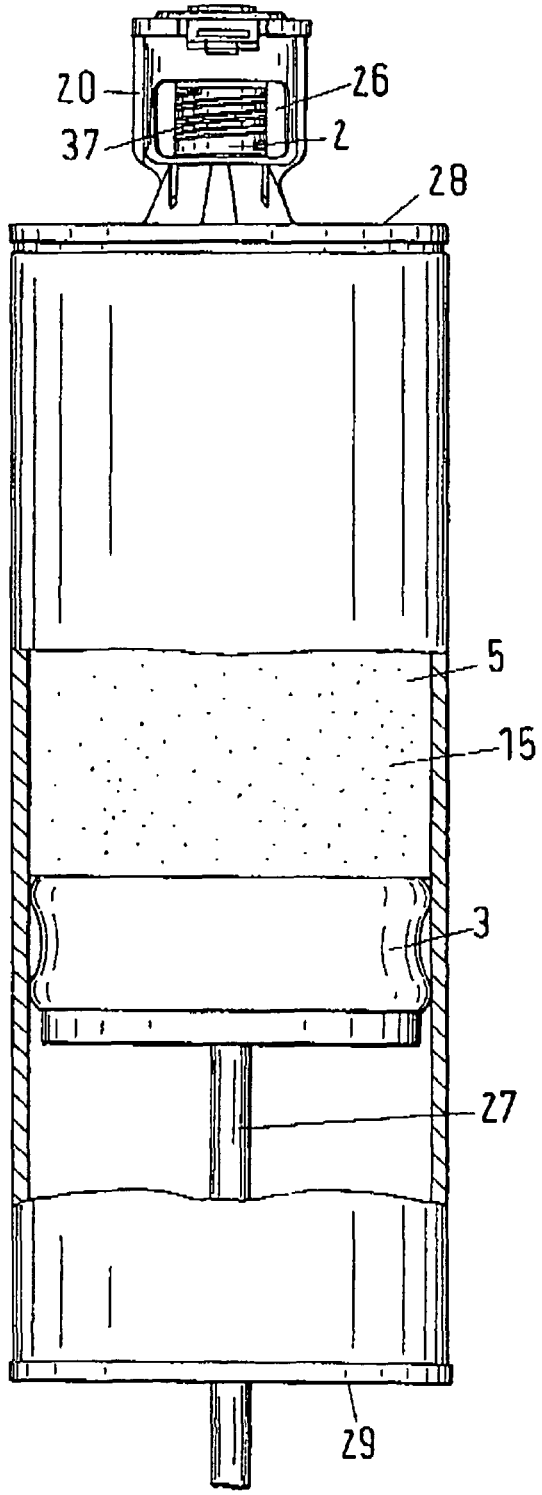

FIG. 8 a side view of the neck of the cartridge of FIG. 4;

FIG. 9 illustrates a view of the cartridge of FIG. 1 with a mixer placed thereon;

FIG. 10 illustrates a section through the cartridge and mixer of FIG. 9; and FIG. 11 illustrates a view, partly in section, of the cartridge of FIG. 6.

Referring to FIG. 1, in a first embodiment, the cartridge 1 serves for the metering of a filler material 15 made up of a plurality of components. The cartridge 1 contains a storage chamber 5 (see FIG. 11) which is made up of a first part chamber 6 for the reception of a first component 8 and a second part chamber 7 for the reception of a second component 9 of the filler material 15. The storage chamber 5 has a discharge end 28 for the dispensing of the filler material 15 and a conveying end 29 which is disposed opposite the discharge end 28 and is visible in FIG. 2 or FIG. 3. The storage chamber 5 thus extends between the conveying end 29 and the discharge end 28 in the tubular section in accordance with FIG. 2.

The storage chamber 5 is surrounded by a housing 34 so that the filler material 15 can be received in the storage chamber 5, as is shown in FIG. 11, or the two components 8, 9 can be received in the corresponding first and second part chambers 6, 7.

The storage chamber 5 contains a neck 2, in which a discharge passage 11, 12 (see FIG. 5) is located, so that the filler material cannot be discharged from the storage chamber 5 in an uncontrolled manner. A first discharge passage 11 is shown in FIG. 1 which is located within a second discharge passage 12. The first discharge passage 11 is thus arranged substantially coaxially to the second discharge passage 12, which is best visible in FIG. 5. The discharge passage 12 in accordance with FIG. 6 or FIG. 1 or the first and second discharge passages 11, 12 in accordance with one of FIGS. 1-5 or FIGS. 7-10 open into a corresponding discharge opening 16, 17. This discharge opening 16, 17 can be closed by a closure cap 13. The cartridge can be closed on the conveying side 29 by a closure element shown in FIG. 3 or FIG. 11. The closure element can be made as an expulsion element, for example as a piston 3, 4, which is displaceable in the storage chamber. When the closure cap 13 is closed and the closure element is located at the conveying end 29, the filler material 15 is enclosed in the storage chamber 5 and is storable at least for a limited period of time.

Figure 2:
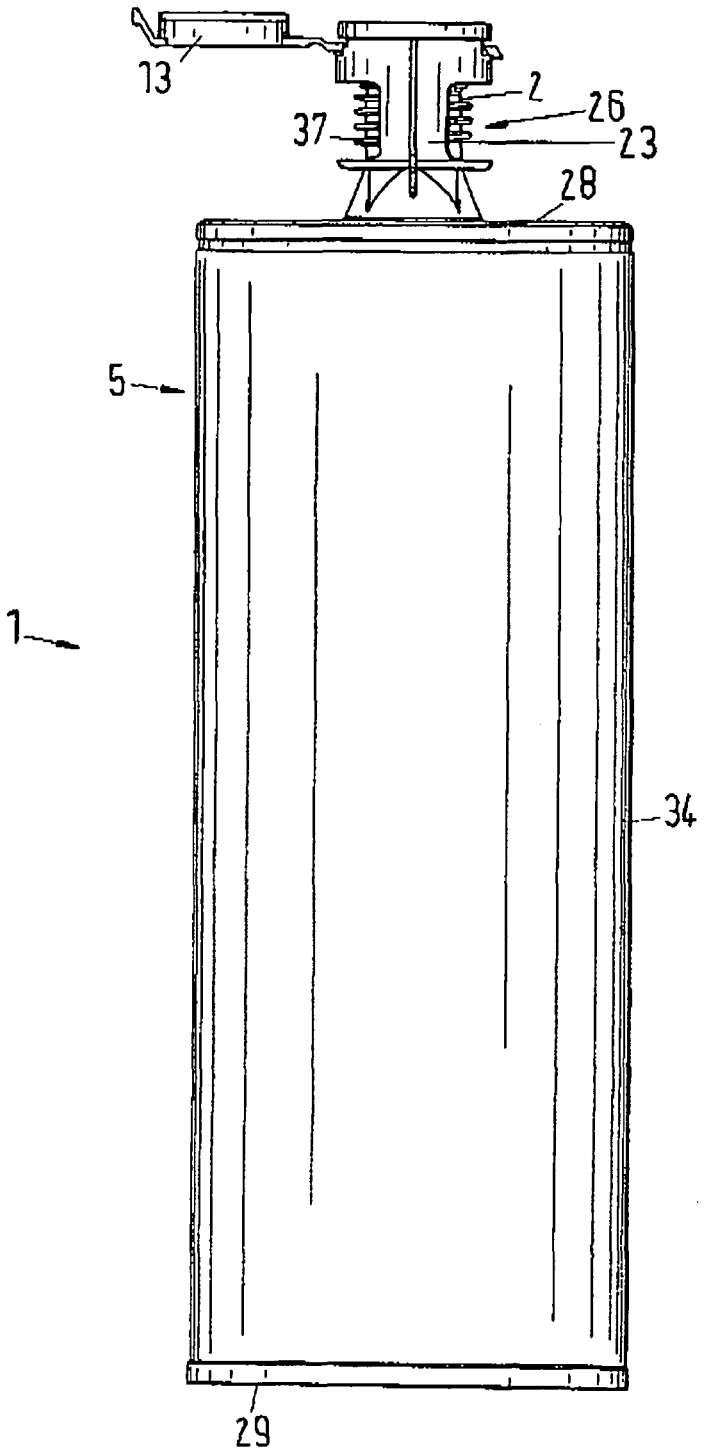
FIG. 2 illustrates a side view of the cartridge of FIG. 1.

FIG. 2 shows a side view of the cartridge 1 in accordance with FIG. 1 for a plurality of components. In FIG. 2, only the first part chamber 6 for a first component 8 is visible; the second part chamber is hidden. The part chambers can naturally also have different volumes if the mixing ratio differs from a 1:1 mixing ratio, that is one of the part chambers can have a correspondingly larger volume than the other part chamber.

Figure 3:
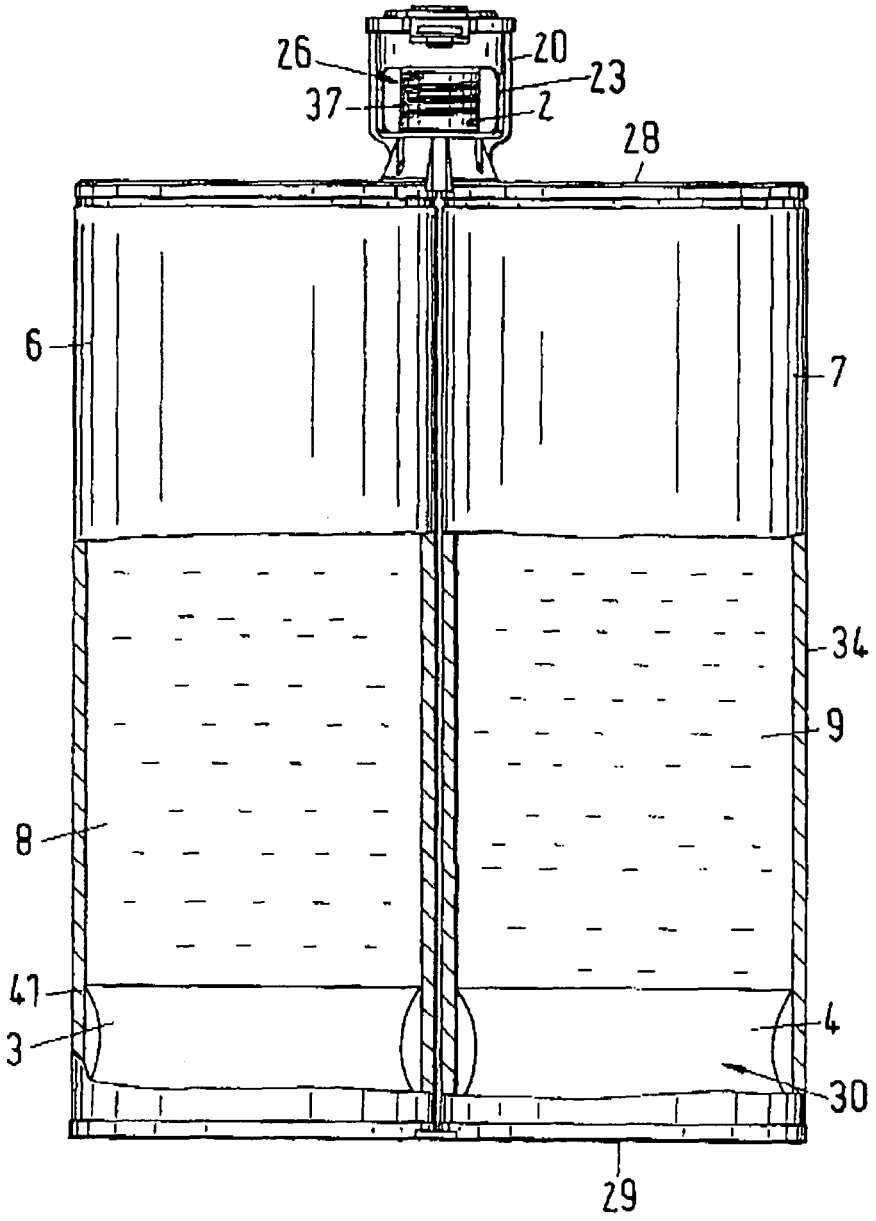
FIG. 3 illustrates a front view of the cartridge of FIG. 1.

FIG. 3 shows a front view of the cartridge, with the cartridge being shown partly in section. The parts of the cartridge already described in connection with FIG. 1 will not be looked at any further at this point. It can be clearly recognized in the sectional representation that the first part chamber 6 is separate from the second part chamber 7 so that the two components 8, 9 do not come into contact with one another. Such components typically interact with one another as soon as they come into contact with one another, with it being possible that chemical reactions take place. The interaction of the components is typically the effect which is required in an application; however, this interaction is not desired as long as the components are not used within the framework of the application intended for them.

Figure 5:
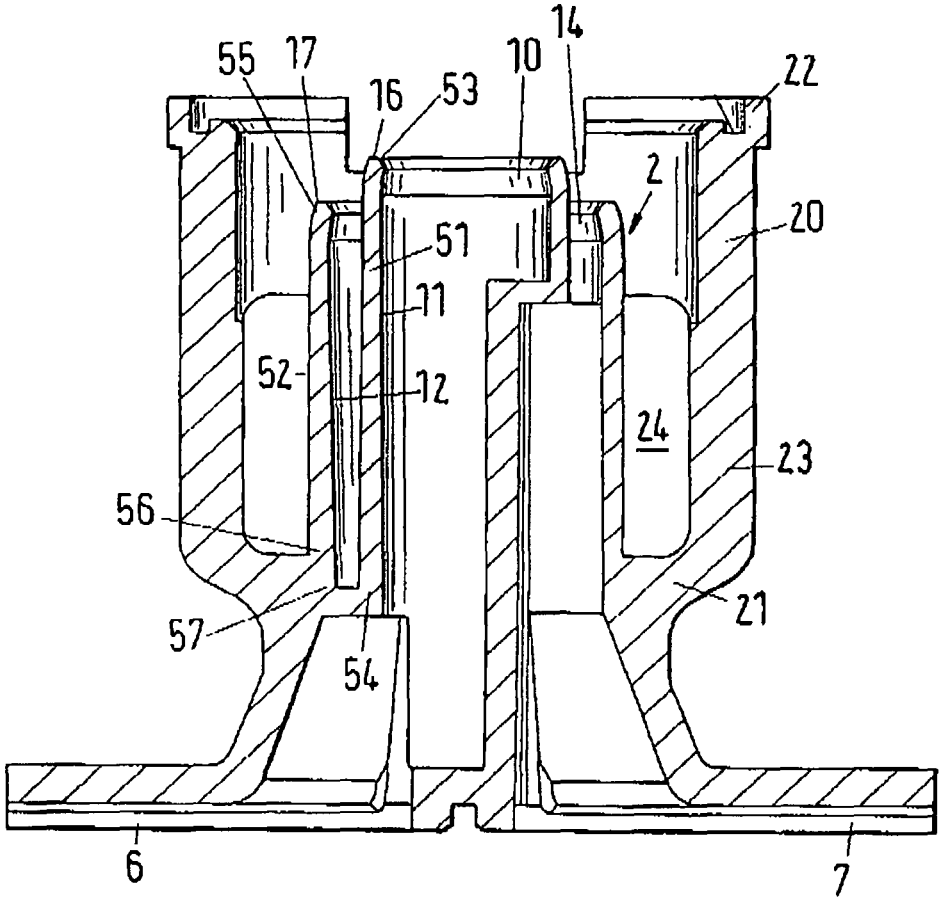
FIG. 5 illustrates a section through the neck of the cartridge of FIG. 4.

The first part chamber 6 and the second part chamber 7 open into a respective discharge passage 11, 12 each which is arranged in the interior of the neck 2 of the cartridge, as is shown in FIG. 5 or 6.

As is shown in part in FIG. 3, an expulsion element 30 can be arranged in each of the part chambers 6, 7 to dispense the corresponding flowable component 8, 9 from the part chamber 6, 7. In FIG. 3, the expulsion element 30 is made up of a first piston 3 and a second piston 4. Only the piston 3 which is provided for reception in the storage chamber 5 is shown in FIG. 11.

The first piston 3 can be movably received in the first part chamber 6 and the second piston 4 can be movably received in the second part chamber 7 so that, on movement of at least one of the first or second pistons 3, 4, the first and second flowable components 8, 9 can be dispensed simultaneously. For this purpose, the first piston 3 and the second piston 4 and the plunger, not shown, are made in one piece or are at least connected to one another via a coupling element such that they can be moved simultaneously.

The first and the second pistons 3, 4 have at least one sealing element 41 which can in particular be made as a sealing lip. A leak of the components 8, 9 can hereby be avoided so that the components can be stored in the part chambers 6, 7.

FIG. 4 shows a view of the neck 2 of a cartridge in accordance with one of the FIGS. 1 to 3. The neck 2 contains a first discharge passage 11 and a second discharge passage 12. The two discharge passages are used for the simultaneous dispensing of the first component 8 and of the second component 9. The neck 2 is surrounded by a shock absorbing element 20. The shock absorbing element 20 envelopes the neck 2 in part. The shock absorbing element 20 has a jacket 23. When the neck 2 and the shock absorbing element 20 are made in one piece, for example in the injection molding process, a tool has to be able to be introduced into the intermediate space within the shock absorbing element 20 between the neck 2 and the shock absorbing element for the manufacture of the neck as well as any connection elements. The shock absorbing element therefore contains at least one opening 26 which is preferably created in the jacket 23.

FIG. 5 shows a section through the neck 2 of the cartridge 1 in accordance with FIG. 4 and FIG. 6 shows a section through the neck 2 of a container. In the following, the term "container" will be used as a generic term so that the now following description applies both to containers of any type in which a filler material 15 is present and to cartridges as a sub-group of containers in which the filler material can be dispensed from the, storage chamber by changing the volume of the storage chamber. The following description furthermore includes any multicomponent cartridge which in turn represents a sub-group of cartridges.

The container 1 includes a storage chamber 5, 6, 7 for the reception of a filler material 8, 9, 15 and includes a neck 2 which contains a discharge passage 11, 12 for the filler material 8, 9, 15 so that the filler material 8, 9, 15 can be dispensed from the storage chamber 5, 6, 7 through the discharge passage 11, 12. The filler material 8, 9, 15 is discharged through a discharge opening 16, 17 arranged at the end of the discharge passage 11, 12. The neck has a longitudinal axis 60. In FIG. 6, the longitudinal axis of the neck coincides with the longitudinal axis of the shock absorbing element 20. The neck 2 is surrounded by the shock absorbing element 20 such that the shock absorbing element 20 has a first end 21 which is connected to the neck 2 and has a second end 22 and the jacket 23 which extends between the first end 21 and the second end 22, with the jacket 23 and the second end 22 being arranged at a spacing from the neck 2.

The second end 22 advantageously projects over the neck 2 so that on an impact only a contact with the shock absorbing element 20 occurs, but the neck located thereunder remains intact.

An intermediate space 24 in which a housing element 25, for example a mixer housing 42, can be received is formed between the jacket 23 and the neck 2.

The neck 2 has a first tube piece 51 defining the first discharge passage 11 and having the first discharge opening 16 at one end 53 of the tube piece 51 and on the longitudinal axis 60 of the neck 2. The neck 2 also has a second tube piece 52 defining the second discharge passage 12 and having the second discharge opening 17 at one end 55 concentric to the first discharge opening 16.

The neck 2 also has a collar 57 that is connected to the respective ends 54, 56 of the tube pieces 51, 52 and that forms the connection to the storage chamber 5 or the respective part chamber 6, 7. The first end 21 of the shock absorbing element 20 is also connected to the second tube piece 52 at the collar 57.

The respective discharge passage 11, 12 has an inner diameter, which is smaller than the inner diameter of the storage chamber 5 or the respective part chamber 6, 7, such that the neck 2 is surrounded by the shock absorbing element 20.

The neck can also be made up of a plurality of tubular stubs in accordance with an embodiment not shown graphically. A first and a second tubular stub are respectively provided for a two-component cartridge. Each of the first and second tubular stubs can have a first sealing element and a second sealing element for the reception of a respective first or second collection element. Each of the collection elements merges into a mixer which can be connected to the discharge passages of the cartridge via the collection element. Such cartridges are shown, for example, in EP 0 730 913.

The discharge passages can be arranged concentrically to one another; in this connection, the term coaxial outlet is frequently used. As is shown in FIG. 5, the discharge passage 11 is located within the discharge passage 12. The discharge passage 12 thus surrounds the discharge passage 11.

Figure 7:
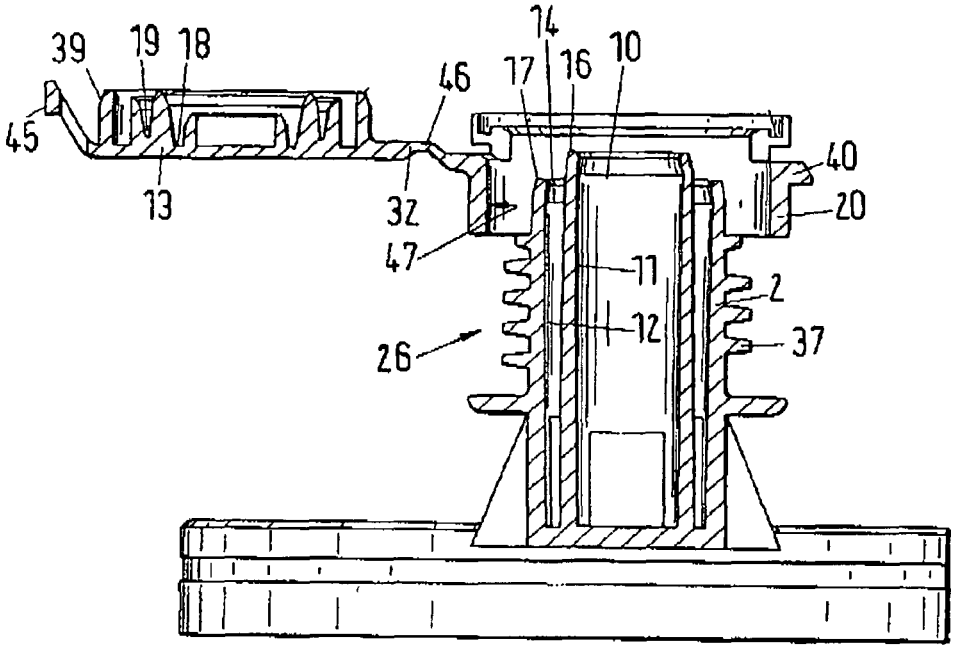
FIG. 7 illustrates a section through the neck of the cartridge of FIG. 4 which is offset by 90° with respect to the section in accordance with FIG. 5.

FIG. 7 is a section through the neck of the cartridge in accordance with FIG. 4 which is offset by 90° with respect to the section in accordance with FIG. 5 and contains the longitudinal axis of the neck 2. The shock absorbing element 20 is made in one piece with the neck 2. The neck 2 contains a first discharge passage 11 and a second discharge passage 12. The first discharge passage 11 opens into a first discharge opening 16 at the end of the passage 11; the second discharge passage 12 opens into a second discharge opening 17 at the end of the passage 12.

A closure cap 13 is provided by means of which each of the discharge openings 16, 17 can be closed. The closure cap 13 contains a first reception element 18 and a second reception element 19. In accordance with the representation in FIG. 7, the first and second reception elements 18, 19 are made as grooves. These grooves serve for the reception of the corresponding ends 16, 17 of the discharge passages when the closure cap 13 holds the discharge passages 11, 12 closed.

The closure cap 13 is connected to the shock absorbing element 20 by means of a connection element 32. The closure cap 13 has an outer margin 39 that is spaced circumferentially from the jacket 23 of the shock absorbing element 20 with the closure cap 13 in the closure position thereof.

The margin 39 advantageously does not contact the inner wall 47 of the shock absorbing element 20. The shock absorbing element 20 can thus deform without hindrance in the event of an impact without the deformation being transmitted to the closure cap 13.

The connection element 32 can in particular be made as a hinge element. The hinge element forms a permanent connection between the closure cap 13 and the cartridge 1, in particular its neck 2 or the shock absorbing element 20, so that the closure cap remains permanently connected to the cartridge both in the open state and in the closed state.

The connection element 32 is elastic. To connect the closure cap 13 for the closure of the corresponding discharge opening 16, 17 to the corresponding end of the discharge passage 11, 12, the reception element 18, 19 is brought into engagement with the corresponding ends. The reception elements 18, 19 are preferably conical so that the ends are clamped in the reception elements 18, 19 by application of a small contact pressure and hold the discharge openings closed in this manner.

When this connection is manually released, the closure cap 13 moves away from the discharge openings 16, 17 into the position shown in FIG. 7. The connection element can have a restriction 46 for the simpler deflection of the closure cap. This restriction is, for example, an indentation or a channel, that is a region of the connection element 32, which has a smaller wall thickness than the regions directly adjoining the closure cap 13 or the cartridge 1.

The margin 39 advantageously has an outer diameter which is larger than the outer diameter of the neck 2. It is hereby ensured that the outermost disposed discharge opening can be held sealingly in the reception element 19 arranged in the proximity of the margin with a closed closure cap.

The margin 39 is formed as a projection 39 which extends at least over a part of the periphery of the closure cap 13. The projection 39 surrounds the neck 2 at least in part.

A fastening element 40 is arranged on the shock absorbing element 20 and a flap is provided on the closure cap 13 for engaging with the fastening element 40 to hold the closure cap in the closure position.

FIG. 8 shows a side view of the neck of the cartridge of FIG. 4.

FIG. 8 and FIG. 9 in particular show that the jacket 23 of the shock absorbing element 20 is arranged concentrically around the neck 2. The opening 26 in the jacket 23 is furthermore shown in this view.

FIG. 9 shows a view of the cartridge 1 with a mixer 31 in place and FIG. 10 shows a section through the cartridge 1 and mixer 31. The mixer 31 is arranged in the mixer housing 42 and is made in one piece with the housing 34. The mixer 31 is in particular designed as a static mixer. The mixer housing 42 can in each case have corresponding sealing element by means of which the corresponding discharge opening at the discharge end 28 of the cartridge can be closed.

In particular, the opening 26 in the jacket 23 (see FIG. 4) can comprise at least a pair of part openings 48, 49. These part openings are in particular formed such, that a tool element is guidable through the part openings. Such a tool part is used to manufacture an external thread 37 on the neck 2. The tool element consists of two halves, which have to be guided through the jacket 23 of the shock absorbing element 20 and about the neck 2. Therefore, an intermediate space 24 is arranged between the jacket 23 of the shock absorbing element 20 and the wall of the neck 2, such intermediate space being at least twice as large as the depth of the external thread 37. The intermediate space 24 is best seen in one of FIG. 4, 5 or 6.

The part openings 48, 49 make up as much as 85%, preferably up to and including 75%, particularly preferred up to and including 65% of the surface of the jacket 23. The more of the surface of the jacket 23 is made up by the part openings 48, 49, the more the manipulation of the tool element is facilitated. Thus, the process of guiding the tool element through the intermediate space between the neck and the jacket requires less precision than if the part opening 49, 49 covers only a relatively minor portion of the surface of the jacket 23. On the other hand, the stability of the shock absorbing element 20 increases, if the portion of the surface of the jacket 23, which is taken up by the totality of the part openings 48, 49 is smaller. Alternatively or in addition thereto, the stability of the shock absorbing element 20 can be additionally enhanced, if a reinforcement element 50, such as a reinforcement rib, is arranged on the jacket 23. Such a reinforcement element 50 can also comprise a portion of increased wall thickness such as a protrusion. Furthermore, a plurality of reinforcement elements 50 can be foreseen.

The height of the part openings 48, 49 is greater than the height of the neck 2 which carries the external thread 37. In this case, the tool element can be safely guided through the openings to the neck and be extracted after completion of the manufacturing step of the external thread 37.

For a cartridge with part chambers 6, 7 arranged next to each other, the part openings 48, 49 are preferably arranged mirror symmetrically to a plane which contains the longitudinal axes of the two part chambers 6, 7. By such an arrangement of the part openings, the shortest path length for the tool element can be realized. The path length is thereby the distance the tool element has to travel to reach the position for manufacturing the external thread 37 onto the neck 2.

The mixer housing 42 can contain a coupling element 43 which is designed for engagement with the neck 2. The coupling element 43 can be received in an engagement element 44 which surrounds the neck 2. The engagement element 44 is made as part of the neck 2. The coupling element 43 can be displaced relative to the engagement element 44 so that the mixer housing can be held either in a closed position or in an open position relative to the mixer and to the discharge end 28. The mixer housing 42 is held, for example, in an open position during the filling so that air which is present in the first or second part chamber 6, 7 can escape via discharge openings which lead to the discharge end 28. The mixer housing 42 is in particular held in its open position for so long until the filling is carried out to avoid a pressure building up in the first or second part chamber 6, 7 which would make a continued filling more difficult. When the filling is completed, the mixer housing 42 is moved into its closed position in which the discharge openings of the discharge passages 11, 12 are held closed.

Referring to FIG. 3, the first and second pistons 3, 4 are movable by means of a plunger 5 to dispense the two components 8, 9 simultaneously. The plunger is in particular designed such that it lies on the first and second pistons 3, 4. The plunger 27 is connected in one piece to the pistons 3, 4 in this embodiment. At the start of the dispensing, the mixer housing 42 is moved from its closed position into the open position. In this position, the discharge openings are connected at the discharge end to the mixer which extends in the interior of the mixer housing. The first and second components 8, 9 as well as any air can be carried into the mixer. The air escapes beforehand through the discharge opening of the mixer housing. Subsequently, the mixing of the first and second components 8, 9 by the mixer 31 takes place. Venting bores or venting grooves, which are not shown in FIG. 5, can be provided at the corresponding piston or at the inner wall of the corresponding part chamber for air which is enclosed between the first piston or second piston 3, 4 and the filler material.

In accordance with any of the embodiments, at least one of the storage chambers 5, 6, 7 can be at least partly transparent so that the filling level of the filler material 8, 9, 15 in the corresponding storage chamber 5, 6, 7 can be monitored.

The operation of the cartridge 1 includes the steps of filling the cartridge 1 with a filler material 8, 9, 15 as well as the dispensing of the filler material.

When the cartridge 1 is filled in accordance with any one of the preceding embodiments, the filling includes the following steps:

docking the cartridge 1 to a reservoir for the filler material, by connecting the storage chamber 5, 6, 7 to a conveying element arranged at the conveying end 29 of the cartridge 1;

opening a venting opening so that air can escape from the storage chamber 5, 6, 7;

introducing the filler material 8, 9, 15 into the storage chamber 5, 6, 7; and closing the venting opening as soon as the storage chamber 5, 6, 7 is filled with filler material 8, 9, 15;

closing the filled storage chamber 5, 6, 7 by means of the closure cap 13;

closing the filled storage chamber 5, 6, 7 by means of an expulsion element 3,4, 30 at the conveying end 29.

The discharge opening for the filler material at the discharge end 28 of the cartridge can in particular also be a venting opening. The user can in particular determine the degree of filling at any time when the progress of the filling is visible at any time since the housing is transparent, i.e. is produced from transparent material or at least has openings which contain transparent material, and can thus reliably avoid filler material exiting the discharge end 28 prematurely. Alternatively or in addition thereto, the closure cap 13 can contain venting openings or can form a venting opening in combination with the neck 2. The size of the venting opening can be adjustable, for example in that a combination of a closure cap 13 with the neck 2 is provided which has at least one conical surface. The spacing between the closure cap 13 and the neck 2 in the region of the conical surface can be designed such that the conical surface closes the opening in a fluid-tight manner in the closed state, enables a discharge of a small amount of air in a partly opened state and allows the discharge of a large amount of air or enables the discharge of the filler material in a completely opened position.

Alternatively or in addition to this, a venting opening can be provided at the piston 3, 4. The venting opening can in this case include a membrane which releases an opening for the discharge of air under pressure or can include a venting valve which opens under pressure or under contact of the plunger. Alternatively to this, an opening or a groove can be provided at the inner wall of the housing or in the jacket region of the piston which prevents a discharge of air between the jacket region of the piston and the inner wall of the housing.

The dispensing of the filler material 8, 9, 15 includes the following steps:

opening the closure cap 13 of the filled storage chamber 5, 6, 7;

dispensing the filler material 8, 9, 15 in that it is pressurized in the storage chamber 5, 6, 7, for which purpose the expulsion element 3, 4 , 30 is displaced such that the filling volume in the storage chamber 5, 6, 7 is reduced.

At least at the start of the dispensing of the filler material, the venting opening, which is in the opened state, can make it possible that air can escape which is still enclosed between the filler material and the piston.

During the filling, a first flowable component and a second flowable component 8, 9 can be introduced into a first filling chamber 6 and into a second part chamber 7 and the first and second flowable components 8, 9 can be discharged from the first and second part chambers 6, 7 during the dispensing, with each of the first and second pistons 3, 4 being displaced by a movable plunger 27 while exerting a compressive force in the corresponding first or second part chamber 6, 7 such that the filling volume in each of the first or second part chambers 6, 7 is reduced.

What is claimed is:

1. A container comprising at least one storage chamber for the reception of a filler material;

a neck extending from said chamber and having a discharge passage for dispensing of the filler material from said storage chamber; and a shock absorbing element made in one piece with said neck and having a first end connected to said neck, a jacket extending from said first end in spaced circumferential relation to said neck to define an intermediate space therebetween and a second end on said jacket opposite said first end and in spaced circumferential relation to said neck and projecting longitudinally beyond said neck, said jacket having at least one opening in a circumferential wall thereof.

2. A container in accordance with claim 1 having a pair of storage chambers and wherein said neck has a first discharge passage communicating with one of said pair of storage chambers, a second discharge passage communicating with another of said pair of storage chambers and a collar integrally connected to said pair of storage chambers and to said first end of said shock absorbing element.

3. A container in accordance with claim 1 wherein said neck has a first tube piece defining a first discharge passage and having a first discharge opening on a longitudinal axis of said neck and a second tube piece defining a second discharge passage and having a second discharge opening concentric to said first discharge opening, and a collar integrally connected to said first tube piece, said second tube piece and to said first end of said shock absorbing element, said first end of said shock absorbing element being connected to said second tube piece at said collar.

4. A container in accordance with claim 3 wherein said intermediate space is formed between said jacket of said shock absorbing element and said second tube piece.

5. A container in accordance with claim 1 further comprising a housing element received in said intermediate space between said jacket and said neck.

6. A container in accordance with claim 1 wherein said jacket is arranged concentrically around said neck.

7. A container in accordance with claim 1 wherein said jacket contains a pair of part openings for guidance of a tool element therethrough to form a thread on said neck.

8. A container in accordance with claim 1 further comprising a closure cap mounted on said neck for closing said discharge passage.

9. A container in accordance with claim 8 wherein said shock absorbing element projects longitudinally beyond said closure cap.

10. A container in accordance with claim 8 further comprising a hinge element connecting said cap to said shock absorbing element.

11. A container in accordance with claim 8 wherein said closure cap has a reception element receiving an end of said discharge passage of said neck therein.

12. A container in accordance with claim 1 further comprising an external thread on said neck and a housing element received in said intermediate space between said jacket and said neck and threaded onto said external thread.

13. A container in accordance with claim 1 having a pair of storage chambers and wherein said neck has a first discharge passage communicating with one of said pair of storage chambers, a second discharge passage communicating with another of said pair of storage chambers, said first discharge passage being coaxial to and within said second discharge passage and an intermediate wall separating said first discharge passage from said second discharge passage.

14. A container in accordance with claim 1 having a pair of storage chambers and wherein said neck has a first discharge passage communicating with one of said pair of storage chambers and having a first discharge opening, a second discharge passage communicating with another of said pair of storage chambers and having a second discharge opening arranged next to said first discharge opening, and an intermediate wall separating said first discharge passage from said second discharge passage.

15. A container comprising a pair of storage chambers;

a neck extending from said storage chambers and having a first discharge passage for dispensing material from one of said pair of storage chambers and a second discharge passage concentric to said first discharge passage for dispensing material from the other of said pair of storage chambers; and a shock absorbing element made in one piece with said neck and having a first end connected to said neck, a jacket extending from said first end in spaced circumferential relation to said neck to define an intermediate space therebetween and a second end on said jacket opposite said first end and in spaced circumferential relation to said neck and projecting longitudinally beyond said neck.

16. A container in accordance with claim 15 further comprising an external thread on said neck and wherein said jacket contains a pair of part openings for guidance of a tool element therethrough to form said thread on said neck.

17. A container in accordance with claim 15 further comprising a closure cap mounted for closing said first discharge passage and said second discharge passage and a hinge element connecting said cap to said shock absorbing element.

18. A container comprising a pair of storage chambers;

a neck extending from said storage chambers and having a first discharge passage for dispensing material from one of said pair of storage chambers and a second discharge passage for dispensing material from the other of said pair of storage chambers; and a shock absorbing element made in one piece with said neck and having a first end connected to said neck, a jacket extending from said first end in spaced circumferential relation to said neck to define an intermediate space therebetween and a second end on said jacket opposite said first end and in spaced circumferential relation to said neck and projecting longitudinally beyond said neck.

19. A container in accordance with claim 18 further comprising an external thread on said neck and wherein said jacket contains a pair of part openings for guidance of a tool element therethrough to form said thread on said neck.

* * * * *